United States Patent [19]

Moraw

[11] 4,142,100

[45] Feb. 27, 1979

[54] PROCESS AND APPARATUS FOR RECORDING AND OPTICALLY REPRODUCING X-RAY IMAGES

[75] Inventor: Roland Moraw, Wiesbaden-Naurod, Fed. Rep. of Germany

[73] Assignee: Hoechst Aktiengesellschaft, Frankfurt am Main, Fed. Rep. of Germany

[21] Appl. No.: 843,368

[22] Filed: Oct. 19, 1977

[30] Foreign Application Priority Data

Oct. 20, 1976 [DE] Fed. Rep. of Germany ..... 2647324

[51] Int. Cl.[2] ..... G03G 15/00

[52] U.S. Cl. ..... 250/315 A

[58] Field of Search ..... 250/315 A

[56] References Cited

U.S. PATENT DOCUMENTS 4,002,906 1/1977 Pekau et al. ..... 250/315 A

FOREIGN PATENT DOCUMENTS 2610514 9/1977 Fed. Rep. of Germany ..... 250/315 A

*Primary Examiner*—Craig E. Church
*Assistant Examiner*—T. N. Grigsby
*Attorney, Agent, or Firm*—Schwartz, Jeffery, Schwaab, Mack, Blumenthal & Koch

[57] ABSTRACT

A method is disclosed for recording and optically reproducing X-ray images on recording material in an ionization chamber which is filled with a gas which can be ionized by X-rays. The gas within the chamber is subjected to a high voltage by means of electrodes. The ionization chamber further includes a recording material in which a deformation image is formed when the material is heated as a result of the exposure to X-ray radiation.

An apparatus is disclosed which may be used to perform the above method which comprises an ionization chamber, electrodes, recording material, and means for heating the recording material.

36 Claims, 3 Drawing Figures

PROCESS AND APPARATUS FOR RECORDING AND OPTICALLY REPRODUCING X-RAY IMAGES

BACKGROUND OF THE INVENTION

1. Field of the Invention

The invention relates to a process and apparatus for optically reproducing and recording X-ray images.

2. Description of the Prior Art

The recording of X-ray images is widely carried out on photographic X-ray films and plates. In recent times images have been recorded by the xeroradiography process in which a photoconductor layer, which is charged before exposure and is preferably made of selenium, is partially discharged by X-rays; the residual charge image being made visible by a toner. The sensitivity of the selenium layers to X-rays is, however, only relatively slight.

In the process disclosed by German Offenlegungsschrift No. 2,436,894, X-ray images at a short access time are recorded on thermoplastic or photoconducting thermoplastic layers in an ionization chamber. For this purpose the thermoplastic recording material is placed on a transparent electrode in the ionization chamber, which is partially transparent to radiation. The chamber is subjected to X-rays which have passed through the object of which an image is to be made and which is located in front of the ionization chamber. A high voltage is applied to the electrodes of the ionization chamber which is filled with xenon under excess pressure. The charges formed in the ionization chamber, which are proportional to the X-radiation, are deposited on the thermoplastic recording layer. When the charge image, which is formed by the precipitation of the charges on the recording layer, is heated, it deforms the softened thermoplastic recording layer to give a relief image, as a result of the electrostatic forces emanating from the charges. The relief image is projected with schlieren optics as a continuous (half) tone image. For the reproduction of the continuous (half) tone image the thermoplastic layer can be provided with a screen by a periodic fine pattern, for example a grid pattern.

In the reproduction of X-ray images, which are recorded on silver film materials or are recorded as electrostatic images on appropriate layers developed with toner, grey gradations are obtained which must be interpreted with regard to their information content based on the experience on the radiographers evaluating them.

It is surprising that the literature describing the state of the art does not contain any mention of X-ray color images, in spite of the knowledge that relief images must be screened for continuous tone reproduction. It would appear that the steps in the process of reproducing X-ray images in color have not been discovered because of the fact that experts have always attempted only to reproduce the usual grey shade gradations by the diffraction effects which occur with the screen, by modulating up to the maximum value the intensities of the light deflected on the periodic structures into the first-order diffraction. Depending on the particular wavelength of the radiated light, this maximum value is reached, on wave-like periodic structures, with differences in the optical path lengths between 0.12 $\mu$m to 0.2 $\mu$m. With relief structures in organic thermoplastic polymers, this corresponds to deformation depths between 0.25 $\mu$m and 0.4 $\mu$m.

A further obstacle to the discovery of a process for the reproduction of colored X-ray images, may also have been that in the state of the art the work in general is carried out with monochromatic laser light and not with polychromatic light.

Attempts have been made (Bild der Wissenschaft, Sept. 1974, page 64) to convert the gray values into color steps for improved discernibility. For this purpose continuous (half) tone images are recopied on equidensity films into color images. However, as a result of the wet development which is necessary, the recopying process is time-consuming in addition to the time involved in the recording process itself.

Making color image recordings on positive photolacquer layers with the aid of rectangular grids is also known. Such processes have proven unsatisfactory when using X-rays, because photolacquer layers are for the most part insensitive to X-rays, so that very long exposure times would be necessary for making color image recordings. There is thus an obvious need in the present state of the art for color-image recordings.

SUMMARY OF THE INVENTION

It is thus an object of the invention to provide a method and apparatus for recording and optically reproducing X-ray images.

It is a further object of the invention to provide a method and apparatus for providing color reproduction of X-ray images.

It is yet another object of the invention to provide a process and apparatus for recording X-rays on thermoplastic recording materials and reproducing these X-ray images in color.

According to the invention X-ray images are recorded and optically reproduced on recording material in an ionization chamber. The chamber is filled with a gas which can be ionized by X-rays when electrodes within the ionization chamber are connected to a high voltage source. When the X-rays to be recorded enter the ionization chamber and the recording material is heated a deformation image is formed. This image corresponds to the charge distribution which is produced during irradiation by the ionization of the gas. The imaged recording material is then cooled to fix the image formed in relief. Effective reproduction of X-ray images in color is accomplished according to the invention by producing periodic differences in thickness in a preferably thermoplastic recording layer, which are proportional to the intensity of the X-ray exposure. According to the invention preferred, periodic differences of at least 0.2 microns are formed.

Production of periodic optical path length differences is preferably accomplished by the projection of a grid pattern onto the recording material.

The process of the invention thus comprises recording X-ray images on recording material in an ionization chamber which comprises providing an ionization chamber which is filled with a gas which may be ionized by X-rays and which further contains two electrodes, and a recording material. A high voltage is applied to the electrodes and X-ray radiation is directed at the ionization chamber such that the ionizable gas is ionized. The recording material is heated so that a deformation image is formed on the surface of the recording material. Additionally, periodic differences in the optical path lengths are produced in said recording material while said chamber is being subjected to X-ray radiation.

The invention also relates to an apparatus for recording X-ray images which comprises a housing filled with an X-ray ionizable gas at an elevated pressure and which contains first and second electrodes and a recording material located between the two electrodes. The housing walls of the chamber are at least partially transparent to optical rays. The apparatus further includes means for producing differences in the optical path lengths through the recording material.

One of the advantages achieved by the invention is that the local differences in the optical path lengths are produced by changes in the thickness of the layer. Because of the relatively high sensitivity to X-rays during the exposure in the ionization chamber used and because of the rapid developability (fractions of a second), the charge images obtained on the thermoplastic recording layers are proportional to the X-ray exposure and can be developed into corresponding relief images by heating for a short time.

DESCRIPTION OF THE PREFERRED EMBODIMENTS

Figure 1:
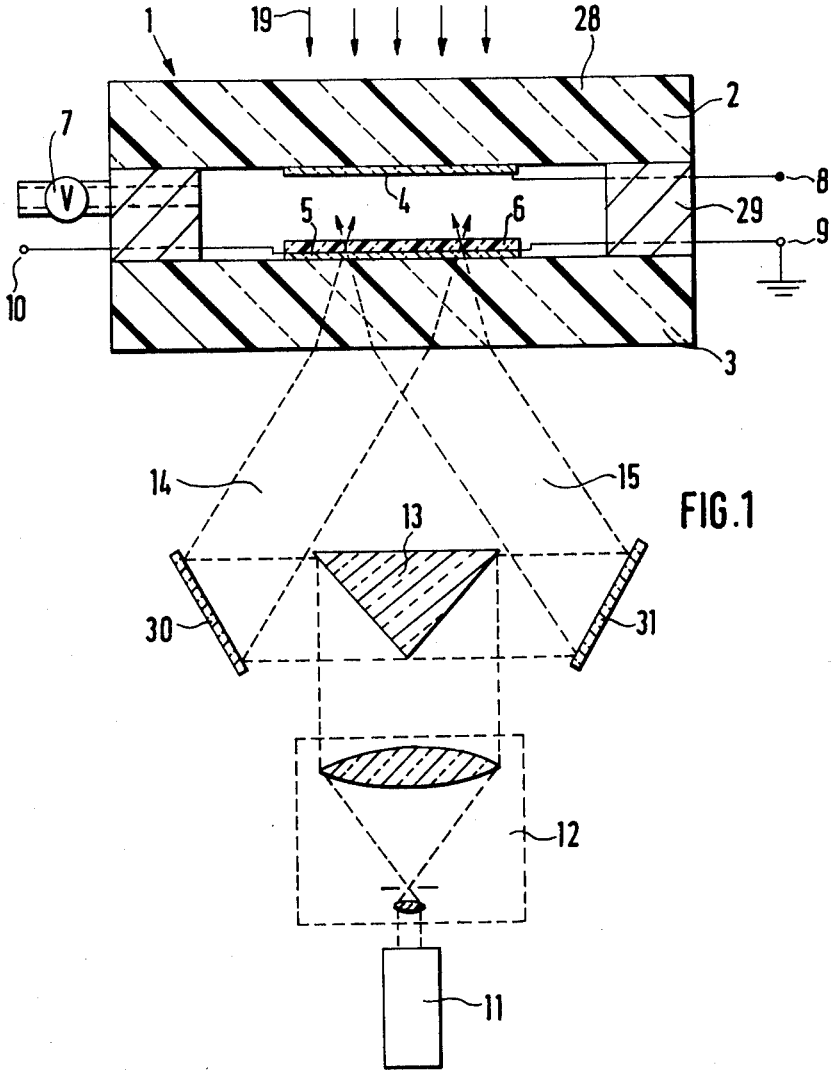
FIG. 1 shows a sectional view through an ionization chamber represented schematically, with a laser, located outside the ionization chamber, to radiate a radiation intensity pattern into the ionization chamber.

The basic construction of a suitable ionization chamber 1 for the recording process is illustrated in FIG. 1. The housing 28 of the ionization chamber 1 consists of a chamber wall 29, and cover plates 2 and 3. The chamber wall 29, in itself closed, is sealed so as to be gas-tight by the stable, transparent upper cover plate 2 and the corresponding lower cover plate 3. The ionization chamber contains a plate capacitor formed by an optically transparent upper electrode 4 in the shape of a conductive plate and an optically transparent lower electrode 5 in the shape of a conductive plate. Thermoplastic recording material 6 is located on the electrode 5. The ionization chamber 1 is filled with an inert gas, such as, for example, xenon, via a gas valve 7. Electrical leads 8 and 9 are passed through seals on one side of the chamber wall 29 to the electrodes 4 and 5 respectively. The lead 9 to the electrode 5 is, for example, grounded while the lead 8 is at high voltage. The electrode 5 is further connected to a second lead 10 on the opposite side. An X-ray beam 19 penetrates the ionization chamber 1 approximately vertically and the X-ray intensity is altered locally by the object under investigation (not shown). In the electric field of the plate capacitor formed by the electrodes 4, 5, the charges and secondary charges, formed by the X-rays 19 in the xenon gas, are moved to the recording material 6 and precipitated there as charge images.

By application of a heating voltage pulse to the leads 9 and 10, the electrode 5 can be heated for the thermal development of the charge images of the recording material 6 lying on it.

For the production of periodic structures, the electrode 5 can consist of a periodically structured conductive layer instead of a homogeneous conductive layer, so that the electric field in the plate capacitor is modulated periodically. For the production of such periodic structures, a periodic charge pattern can be applied by electron radiation, in addition to the charges on the recording material from X-ray exposure.

In general, however, optical methods are preferred because of the low cost of equipment and because of the large number of periods per unit length which can be achieved. For this purpose, recording layers are needed which under the influence of a charge image not only deform on softening but in addition become photoconductive under the influence of light. Such photoconductive thermoplastic layers may comprise for example: copper phthalocyanine in polystyrene or a double layer of poly-N-vinylcarbazole with an addition of trinitrofluorenone and a thermoplastic cover layer of methacrylate-styrene copolymer, although any other layers having the desirable characteristics may be used.

The periodic pattern of light intensity can be produced by projection of a grid mask onto the recording material or preferably by laser double-beam interference. For this purpose, the light of a laser 11 located in front of the lower cover plate 3 is made to diverge by optical element 12, and is split by a beam splitter 13 into sub-beams 14 and 15 and brought together again in the recording layer of the recording material 6. With this type of screen, periodic deformations of sinusoidal cross-section are produced in the recording layer, by interference of the two sub-beams 14, 15.

After the exposure to X-rays and to the laser interference, the periodically structured relief image is thermally developed by heating.

Figure 2:
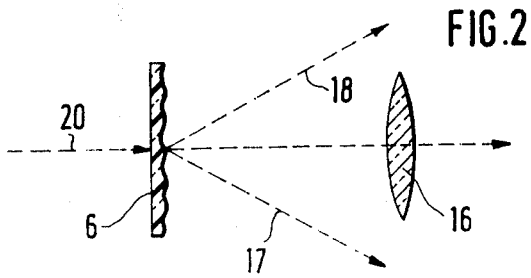
FIG. 2 shows in principle a scheme for reproducing the recorded relief images.

The reproduction of this relief image is effected, as shown in FIG. 2, by an optical element or series of lenses 16 which have a focal length adjusted in such a way that the light 17 and 18 of a polychromatic light source 20, which is diffracted on the periodic structures of the recording material 6, does not enter the optical element 16. In this way the relief image is reproduced in the image colors. If, vice versa, only the diffracted light is used for recording, the image colors change towards the complementary colors. The customary projector type filament lamps, but especially xenon high-pressure lamps, are suitable as light sources for the projection.

The production of colored X-ray images requires the process steps of exposure to X-rays in the ionization chamber 1, whereby the recording material 6 is charged electrostatically, exposure with a periodic intensity pattern, in order to structure the charge image periodically, and thermal development of the charge image to give a periodically structured relief image. This is followed by projection with polychromatic light. For the production of colored X-ray images, the photothermoplastic recording layer must be charged, by the X-ray exposure, in the regions of greatest X-ray intensity up to the breakdown voltage of the recording layer, because only then are clear color effects obtained. Additionally, color gradations occur at somewhat lower charge voltages than the breakdown voltage. The breakdown voltage per $\mu$m of layer thickness is on the order of $10^2$ volts. The subsequent exposure with the periodic intensity pattern must be chosen so that the deformation depth is maximized, that is to say the irradiation with the intensity pattern must be taken only to a point just before over-exposure since otherwise, on exceeding the intensity of exposure, the deformation depths are reduced again by a levelling-out of the deformations.

The selection of operating points in the saturation region of characteristic curves is not customary if proportional relationships are to be recorded. In the present case, however, although the operation points lie near the saturation region, as can be seen by reference to the examples which follow below, the gradations of the X-ray intensities are well shown by the color effects which are readily discernible visually. Operating near the saturation regions of the electrostatic charge and the periodic exposure with easily manageable, deformable thermoplastic layers of 1 μm up to 5 μm with double layers, or up to about 12 μm with homogeneously photoconducting thermoplastic layers, leads to the large deformation depths required for the color effects. A more detailed examination of recordings with color effects shows that for color effects the deformation depths must be at least 0.4 μm. This applies to deformations against air for which the difference of the optical path lengths is particularly large, as a result of the refractive index of air of about one. The difference in the optical path lengths is given by $d(n_1 - n_2)$, where d = the deformation depth, $n_1$ = the refractive index of the thermoplastic recording material and $n_2$ = the refractive index of the external medium. Using other external media than air, the refractive index of which is near that of the recording material requires deformation depths for color effects greater than in air. In the following Example 1, the process according to the invention for recording an X-ray image in color and the determination of the minimum deformation depth required for recording an X-ray image in color, are described in detail. For this purpose the deformation depth d is determined from the intensities, which correspond to the squares of the first-order Bessel function $I_1^2(\phi)$, of the monochromatic light diffracted in the first order on the periodic structures, where the phase $\phi = 2\pi/\lambda \cdot d \cdot (n_1 - n_2)$, with λ = the wavelength of the light, $n_1$ = the refractive index of the deformed layer and $n_2$ = the refractive index of the external medium, for example air.

Figure 3:
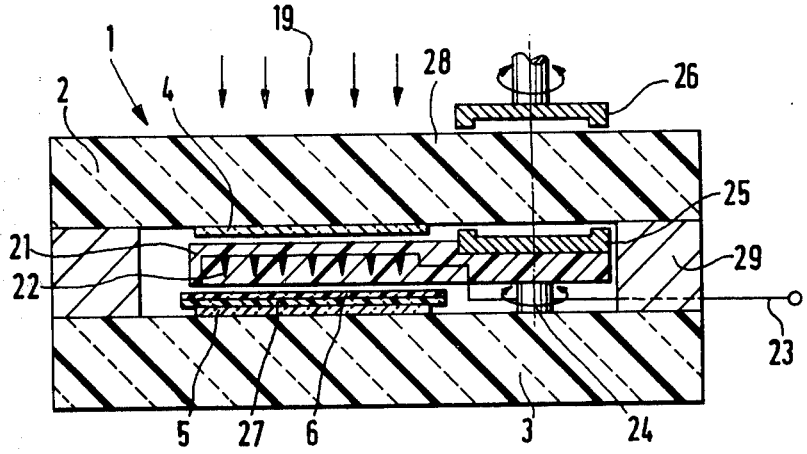
FIG. 3 shows a modified embodiment of the ionization chamber of FIG. 1 having a pivotable corona.

FIG. 3 shows an ionization chamber which additionally comprises a corona 22 in a corona housing 21. The rotatable corona housing 21 consists of a flat housing of a synthetic material, approximately 8 mm high, in which several corona needles, each spaced by 4 mm, are embedded, pointing downwards. The needles are connected to a flexible high-voltage lead 23 which is led outwards through the chamber wall 29. The housing of a synthetic material can be pivoted about an axle 24 outside the region of the plate capacitor, in such a manner that the corona 22 can be passed in between the electrodes 4 and 5 of the plate capacitor.

A magnet 25 which can have, for example, a horseshoe cross-section and is embedded in the top of the corona housing 21 is fixed to the axle 24. The magnet 25 is entirely within the interior of the housing 28 of the ionization chamber 1. Outside the housing 28, the axle 24 continues as an extension and carries a further magnet 26, which has the same cross-section as the inner magnet 25. With the outer magnet 26, the pivoting movement of the corona housing 21 can be carried out from the outside. The two magnets 25 and 26 can be components of customary commercial magnetic couplings.

EXAMPLE 1

In the ionization chamber 1, which is darkened from outside by a black-colored foil, a 50 mm × 50 mm piece of photoconducting thermoplastic recording material 6 is irradiated with X-rays at a voltage of 60 kV and a current strength of 4 mA for 30 seconds, as controlled by the time switch of an X-ray installation.

The recording material 6 used consists of a conductive carrier plate of glass which is coated with a 2 μm thick photo-conducting layer of 70% by weight of poly-N-vinylcarbazole and 30% by weight of 2,4,7 trinitrofluorenone, the layer being covered by a 1 μm thick covering layer of a styrene-methacrylate copolymer with a softening point of about 55° C.

The ionization chamber 1 corresponds to the embodiment according to FIG. 1 with the annular chamber-housing 29 with 2 cm thick cover plates 2 and 3, being made of glass-clear Plexiglas. In the ionization chamber 1 there are two glass plates, of dimensions 50 mm × 50 mm × 3 mm, which are covered on one side with a conductive transparent layer of 20 ohm/square surface resistance and which, on opposite sides, have solderable electrodes approximately 10 mm wide. The recording material 6 rests on the lower plate. The plates are so arranged, at a distance of about 1 cm from each other, that the conductive sides are facing each other.

In operation, the ionization chamber 1 is filled with xenon at a pressure of about 1.2 atmospheres. A voltage of +10 kV is applied to the upper conductive transparent plate; the lower transparent plate is grounded.

Subsequently, an optical intensity pattern with a period of 1/300 mm is radiated through the transparent ionization chamber 1 by laser double-beam interference. For this purpose, for example, the red light (633 nm) of a He/Ne laser with a beam power of 5 mW is widened to a beam diameter of 12 mm and split into the two sub-beams 14 and 15 which are brought together again in the region of the recording material 6 by means of mirrors 30 and 31. For example, use of radiation having an energy of 1 μWs/cm² has been found to lead to maximum periodic deformations. For the thermal development of the relief image, the lower transparent conductive plate is heated by a voltage of 80 volts being applied for 0.15 seconds via the leads 9 and 10 to the electrodes lying opposite each other.

The relief image on the recording material 6 can be viewed through the cover plates of the ionization chamber 1 or after removal from the chamber. On vertical irradiation of the recording material 6 with white parallel xenon light and projection, using a lens with f = 24 cm, onto a projection screen at a distance of 3 m, a circle is reproduced with the periodic grid structure in red color.

In the same way, recording materials were irradiated for 7, 10, 14, 18 and 25 seconds with X-rays, and with an optical intensity pattern of an energy of 1 μWs/cm², and thermally developed. The colors appearing in the projection are collated in the table which follows.

Table 1

| Testpiece No. | X-ray exposure | Image color | Inital voltage | Diffraction efficiency | Deformation depth in μm |
|---|---|---|---|---|---|
| 1 | 7 seconds | greyish (very weak) | + 220 V | 1% | — |
| 2 | 10 seconds | grey-brown | + 320 V | 4.5% | 0.08 |
| 3 | 14 seconds | grey-brown | + 395 V | 32% | 0.32 |

Table 1-continued

| Testpiece No. | X-ray exposure | Image color | Inital voltage | Diffraction efficiency | Deformation depth in μm |
|---|---|---|---|---|---|
| | | (violet) | | | |
| 4 | 18 seconds | green | + 410 V | 2% | 0.48 |
| 5 | 25 seconds | yellow-red | + 430 V | 7% | 0.58 |
| 6 | 30 seconds | red | + 445 V | 10% | 0.60 |

The table shows that the image colors change with increasing X-ray exposure. After the initial grey-brown images, which are indefinable as colors; green, yellowish and red images are obtained successively over the whole area.

The measured initial voltages of the individual testpieces, which are exposed to X-rays with light excluded, are given in Table 1. For this purpose the testpieces were removed from the ionization chamber 1 and placed in front of an electrometer probe. As shown in Table 1, color effects appear at relatively high initial voltages.

In addition, the developed testpieces were irradiated with monochromatic red light of wavelength 633 nm from a He/Ne laser and the intensity $I_o$ of the radiated light as well as the intensity I of the light diffracted in the first order was determined. The ratio $I/I_o$ is designated as the diffraction efficiency; the corresponding values are also given in Table 1. The diffraction efficiency obviously passes through a maximum with Testpiece No. 3. The deformation depth of the periodic relief pattern can be deduced from the diffraction efficiency (compare H. Kiemle and D. Röss, Einführung in die Technik der Holographie, [Introduction to Holographic Techniques], Akad. Verlagsgesellschaft, Frankfurt/M. 1969, pages 194–196). The changes in layer thickness obtained in the evaluation are given in the last column of Table 1, the refractive index of the deformable layer having been determined previously at 1.52. It can be clearly seen that colored images only appear at changes of layer thickness above 0.4 μm. With changes of layer thickness of about 0.4 μm, the transition to colored images begins with isolated patches of violet color.

After the image has been viewed through the closed ionization chamber 1, the relief image can be erased again by renewed heating by application of a voltage pulse, at a voltage of 80 volts for a period of 0.6 seconds, to the lower conductive layer. The next exposure can then be made without opening the chamber.

The process specified can advantageously be made still more sensitive if the layer voltage required for the production of the periodic relief image is applied not only by the X-ray exposure but by changing the recording material with a corona or with electron radiation as well. The charge carriers for the production of a grid structure are obtained for example, by means of a grid held at a slight distance above the thermoplastic layer.

With the exposure to X-rays, an additional portion of voltage, which contains the information, is then added to the portion of voltage contributed by the charging. In this process, the corona charging and the charging by the X-ray exposure can be of the same polarity so that, as described in connection with the first example, regions of high X-ray intensity are reproduced by red image colors. Vice versa, with unequal polarities of corona charging and charging by the X-ray exposure, regions of low X-ray intensity are reproduced by red image colors. By this means it is possible to match the color indication to the particular problem. A sinusoidal cross-section of the relief images can also be obtained when the corona is run with half-wave voltage.

EXAMPLE 2

A 60mm × 60mm piece of a photoconducting thermoplastic recording material 6 is placed on the lower capacitor plate and fixed at the side to the base of the chamber with insulating adhesive tape. The recording material 6 consists of a 50 μm thick polyester film 27 with a 4 μm thick photoconducting layer of 70% by weight of poly-N-vinylcarbazole and 30% by weight of 2,4,7-trinitrofluroenone and a 1.5 μm thick thermoplastic covering layer of methacrylate-styrene copolymer with a softening point of about 55° C. A stepped wedge or step tablet of 0.2 mm thick lead layers is laid on the closed ionization chamber 1 filled with xenon. The lead layers of 0.2/0.4/0.6/0.8/1 mm thick lead have dimensions of 5mm × 10mm. The ionization chamber prepared in this manner is shielded against light by a black-colored foil. The recording material 6 is first charged electrostatically by the corona 22, to which a high voltage of plus 8 kV is applied. The ionization chamber is then irradiated with X-ray radiation, at a voltage of 70 kV and a current strength of 3 mA, for about one second, controlled by the timing switch of the X-ray installation. In this process a negative voltage of 10 kV is applied to the upper capacitor plate. The recording material 6 is then irradiated for a tenth of a second with interfering red laser light with a period of 1/250 mm and a total energy of 1 $\mu Ws/cm^2$. Finally, the relief image on the recording material 6 is developed by a heating voltage pulse of 0.2 seconds duration and a voltage of 80 volts on the lower plate of the capacitor. On projection a colored step-wedge image is obtained, the color gradations of which are collated in Table 2:

Table 2

| Testpiece No. | Lead thickness (mm) | Image Color | Relative intensities with green light |
|---|---|---|---|
| 1 | 0 | grey-brown | 0.5 |
| 2 | 0.2 | green | 0.2 |
| 3 | 0.4 | yellow-green | 0.7 |
| 4 | 0.6 | yellow | 0.8 |
| 5 | 0.8 | red-yellow | 0.9 |
| 6 | 1.0 | red | 1.0 |

The gradations of X-ray intensities, obtained by means of the lead layers, are again shown by the different colors. As a result of the pre-treatment by electrostatic charging before the X-ray exposure with a polarity opposite thereto, a color reversal takes place so that areas with a relatively small X-ray exposure are reproduced in a red image color.

The radiographer has hitherto been familiar with the evaluation of intensity gradations without color effects. On introduction of, for example, a green-colored glass with a maximum transmission in the green region of the spectrum, colors signals are converted into isochromatic brightness gradations. The relative intensities of the gradation images, measured by an interference filter with a maximum transmission at 520 nm, are given in the last column of Table 2. The sequence of relative intensities is apparently broken solely by Testpiece No. 1, but it should also be noticed in this connection that also no color effect has appeared on this testpiece.

Appropriate thicknesses of the recording layers are required for the optimum design of the recording process. The color effects according to the invention occur only at deformation depths of at least 0.4 μm against air. The colors blue/green/yellow/red are passed through up to deformation depths of about 0.6 μm. In order to achieve such deformations experimental determinations have shown that the deformable thermoplastic layers must be somewhat thicker than the deformation depths desired, preferably by about 1 μm and more. On the other hand, it is a peculiarity of electrostatic relief images produced on thermoplastic layers that particularly well-developed, periodic relief structures are obtained when the period length is approximately double the thickness of the thermoplastic layer. With a 1 μm layer this means a period or period length of $2d = 2\ \mu m = 2\times10^{-3}$ mm = 1/500 mm, and with a 5 μm layer a period length of about 1/100 mm. The diffraction angle at a grid structure of 1/100 mm period length is, however, smaller than at a structure of 1/500 mm. With increasing thickness of the thermoplastic layer, and hence increasing period length, the separation of the diffracted light from the undiffracted light becomes increasingly difficult because of the decreasing diffraction angle. Thermoplastic layers having thicknesses between 1 μm and 2 μm are therefore preferably employed.

The process can be modified so that recordings can also be made which are, to a large extent, independent of the relationship between the periodic length and the thickness of the thermoplastic layer. For this purpose the various steps in the process are carried out not sequentially but simultaneously, that is to say, for example under the operating conditions of Example 1, in such a manner that the X-ray exposure, the grid exposure and the thermal development occur at the same time. The process technology of simultaneous process steps has itself previously been employed for recording holograms (Credelle and Spong, RCA-Rev. 33 (1972) 206).

With this process technology, color images can still be produced on 0.5 μm thick thermoplastic layers, as well as on thermoplastic layers thicker than 2 μm to 3 μm, and the period length can be chosen as desired. The image colors produced appear at first in the usual sequence blue/green/yellow/red. With greater deformation, irregularities occur and the image colors tend to a yellow/red/blue/green sequence.

Although the above process and apparatus has been described with respect to certain specific materials, dimensions and operating voltages, it is to be understood that the invention is not limited to only those parameters disclosed. Instead the invention is to be construed as encompassing all equivalents and alternative embodiments falling within the scope of the claims.

I claim:

1. A process for recording X-ray images on recording material in an ionization chamber which comprises the steps of:

(a) providing an ionization chamber which is filled with a gas which may be ionized by X-rays and which further contains two electrodes and a recording material;

(b) applying a high voltage to said electrodes;

(c) directing X-ray radiation at said chamber such that said ionizable gas is ionized;

(d) producing periodic differences in the optical path lengths in the layer of said recording material while said chamber is being subjected to X-ray radiation; and (e) heating said recording material to form a deformation image on the surface of said recording material.

2. The process as defined by claim 1, wherein said heated recording material having said deformation image on its surface is cooled to fix said image.

3. The process as defined in claim 1, wherein said periodic differences in the optical path lengths are proportional to the intensity of the X-ray exposure.

4. The process as defined in claim 3, wherein said periodic differences in the optical path lengths formed are at least 0.2 microns.

5. The process as defined by claim 1, which further comprises projecting a grid pattern onto said recording material so as to produce and structure said periodic optical path length differences.

6. The process as defined by claim 1, which further comprises exposing said recording material to a radiation intensity pattern by means of double-beam interference from a coherent beam source.

7. The process as defined by claim 6, wherein said interference is created by passing light from said coherent light source through an optical element for splitting said beam into two sub-beams and reflecting each of said sub-beams onto said recording material.

8. The process as defined by claim 6, wherein said recording material is deformed with a sinusoidal cross-section by means of double-beam interference.

9. The process as defined by claim 1, which further comprises forming periodic charge patterns on said recording material.

10. The process as defined by claim 1, wherein said image is formed in relief by heating said recording material after said ionization chamber has been irradiated by said X-ray radiation.

11. The process as defined by claim 1 which comprises subjecting said recording material to X-ray radiation which results in voltages just below the breakdown voltage of said recording material in the regions of said material being subjected to the maximum voltages.

12. The process as defined by claim 11, wherein said maximum voltages are approximately 100 volts per micron thickness of said recording material.

13. The process as defined by claim 1, wherein said recording material is exposed to X-ray radiation up to just before the saturation region so as to achieve maximum deformation depth.

14. The process as defined by claim 1, wherein said deformation depth against air is at least 0.4 microns.

15. The process as defined by claim 1, wherein said recording material is charged by a corona charging prior to said X-ray exposure.

16. The process as defined by claim 15, wherein said corona charging and said charging by X-ray exposure are effected with the same polarity.

17. The process as defined by claim 14, wherein said corona charging and said charging by X-ray exposure are with different polarity.

18. The process as defined by claim 1, which further comprises optically reproducing said image deformations in color by irradiating said recording material with polychromatic light.

19. The process as defined by claim 18, wherein said irradiation of said recording material results in the diffraction of part of the light used to irradiate the recording material at locations having different optical path lengths; said deformation image being reproduced in color resulting from illumination by the remaining portion of polychromatic light which has not been diffracted.

20. The process as defined by claim 18, wherein said irradiation of said recording material results in the diffraction of part of the light used to irradiate the recording material at locations having different optical path lengths; said image being reproduced by said diffracted light so as to reproduce said deformation images in color complementary to the colors of said images.

21. The process as defined by claim 1, which further comprises simultaneously optically irradiating said recording material with a periodic intensity pattern, heating said recording layer, and exposing said chamber to X-ray radiation.

22. The process as defined by claim 1, wherein said exposure of said recording material to said X-ray radiation, said optical irradiation with a periodic intensity pattern, and said heating of said irradiation layer are performed sequentially.

23. The process as defined by claim 1, wherein said recording material is in the form of a layer and said layer has a thickness of between about 0.5 and about 3 microns.

24. The process as defined by claim 23, wherein said layer has a thickness of between about 1 and 2 microns.

25. The process as defined by claim 1, wherein said recording material having said deformation image formed thereon is heated and then cooled to erase said image deformations.

26. The process as defined by claim 1 wherein said ionization chamber is sealed.

27. An apparatus for recording X-ray images which comprises:

a housing filled with an X-ray ionizable gas at an elevated pressure and containing first and second electrodes, a recording material located between said two electrodes, said housing having walls which are partially transparent to optical rays; said apparatus further comprising a means for producing periodic differences in the optical path lengths through said recording material.

28. The apparatus of claim 27, wherein said means for producing periodic differences in said optical path lengths comprises a coherent light source and means for splitting light emitted from said coherent light source for producing two sub-beams of light which interfere with said recording material.

29. The device as defined by claim 28 wherein said coherent light source is a laser.

30. The device as defined by claim 27, wherein said first and second electrodes are transparent to optical rays and said recording material is in the form of a thermoplastic layer supported by said second electrode.

31. The device as defined by claim 28, which further comprises means to cause light emitted from said coherent light source to diverge and a splitter for splitting said diverging light into two sub-beams.

32. The apparatus as defined by claim 27, wherein said housing further comprises a corona discharge element located between said first and second electrodes.

33. The apparatus as defined by claim 32 wherein said corona discharge element is pivotable so that it may be pivoted into and out of the space between said two electrodes.

34. The apparatus as defined by claim 33, wherein said corona element is mounted in said housing to pivot around a first axle and said first axle is attached to a first magnet.

35. The apparatus as defined by claim 34, which further comprises a second axle outside of said housing which is aligned with said first axle; said second axle being provided with a second magnet which is magnetically coupled to said first magnet.

36. The apparatus as defined by claim 35, wherein said first and second axles are aligned such that rotation of said second axle results in rotation of said first axle.

* * * * *